US005949458A

United States Patent [19]

Studholme

[11] Patent Number: 5,949,458

[45] **Date of Patent: *Sep. 7, 1999**

[54] INK CARTRIDGE FOR AN INK JET PRINTER

[75] Inventor: John Studholme, Boston, United Kingdom

[73] Assignee: Dynamic Cassette International Limited, Boston, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/647,780

[22] Filed: May 15, 1996

[30] Foreign Application Priority Data

May 16, 1995 [GB] United Kingdom ..... 9510131
May 17, 1995 [GB] United Kingdom ..... 9509947

[51] Int. Cl.[6] ..... B41J 2/175

[52] U.S. Cl. ..... 347/86; 347/93

[58] Field of Search ..... 347/85, 86, 87, 347/93

[56] References Cited

U.S. PATENT DOCUMENTS

| | | | |
|---|---|---|---|
| 4,484,827 | 11/1984 | Price, Jr. | 401/205 |
| 4,967,207 | 10/1990 | Ruder | 347/7 |
| 5,420,625 | 5/1995 | Dietl et al. | 347/85 |

FOREIGN PATENT DOCUMENTS

| | | | |
|---|---|---|---|
| 0 553 535 | 8/1993 | European Pat. Off. | B41J 2/175 |
| 0 635 373 | 1/1995 | European Pat. Off. | B41J 2/175 |
| 0 647 527 | 4/1995 | European Pat. Off. | B41J 2/175 |
| 0 699 532 | 3/1996 | European Pat. Off. . | |
| 4-110157 | 4/1992 | Japan | 347/93 |
| 1118411 | 8/1964 | United Kingdom . | |
| 2 045 043 | 10/1990 | United Kingdom . | |
| 2 269 784 | 2/1994 | United Kingdom | B41J 2/165 |

*Primary Examiner*—N. Le
*Assistant Examiner*—Thinh Nguyen
*Attorney, Agent, or Firm*—Pillsbury Madison & Sutro

[57] ABSTRACT

An ink cartridge for an ink jet printer has a tank defining an ink reservoir, and an outlet port from the tank. The outlet port is arranged to receive an ink withdrawal needle of the printer. A fibrous body is provided in the port to act as a filter and wick for ink passing through the port.

18 Claims, 3 Drawing Sheets

INK CARTRIDGE FOR AN INK JET PRINTER

BACKGROUND OF THE INVENTION

The invention relates to an ink cartridge for an ink jet printer.

A known ink cartridge for an ink jet printer is disclosed in European patent application no. 0553535. That application discloses a cartridge defining an ink reservoir and including an ink supply port formed unitarily with a bottom surface of the cartridge housing. The port is pipe shaped. A mesh filter is fuse-bonded onto the top of the inner end of the ink supply port. The filter is stated to be formed of a high polymer material or an anti-corrosion metal such as stainless steel. A sealing film is fuse-bonded onto the other end of the ink supply port. An O-ring is provided behind the backing member. A porous member is provided inside the cartridge reservoir and in contact with the mesh filter. A further porous member is provided in the outlet port. The cartridge is supplied in a sealed bag which is at less than atmospheric pressure.

In use, the cartridge is fitted onto a hollow ink supply needle of an ink jet printer. The needle pierces the sealing film on the outer end of the ink supply port and the O-ring seals around a needle. The tip of the needle enters the porous member in the ink supply port and ink can then be withdrawn from the cartridge through the needle.

SUMMARY OF THE INVENTION

According to the invention there is provided an ink cartridge for an ink jet printer, the cartridge comprising means defining an ink reservoir, means defining an ink outlet port from the reservoir the outlet port being arranged to receive an ink withdrawal member of an ink jet printer and a porous body in the port to act as a filter and wick for ink passing through the port.

In this way, the porous body in the outlet port of the cartridge of EP 0553535 can be replaced by a porous body having pre-determined filter and wick properties and the mesh filter on the inner end of the outlet port is no longer required.

The porous body may be arranged to act as a filter for particles of any suitable size. In particular the porous body may be arranged to act as a filter for particles of a size greater than 100 micrometres or for particles of a size greater than 20, 15 or even 10 micrometres.

The porous body may take any suitable form and preferably the porous body is fibrous. The porous body may comprise fibres which are staple or continuous along the dimension of the body in the flow direction of the port. The fibres may be man made or natural. The porous body may comprise cellulose acetate fibres. The fibres may be bonded using a solvent, heat bonded or resin bonded. The porous body may comprise fibres bonded together with triacetin. The porous body may alternatively comprise a solidified foam.

The porous body is preferably spaced away from the inner end of the outlet port. A porous element may be provided in the reservoir and the porous body and the porous element are preferably arranged such that they do not contact one another. This is particularly useful where two conductors are provided, one in the outlet port and one in the reservoir, the conductors being monitored to detect emptying of the reservoir of ink. A gap will be left at the top of the inner end of the outlet port and when the volume of ink in the reservoir falls below a certain level the outlet port the current path between the two conductors through the ink will be broken. If, for example, the porous body and porous element were in contact then a siphon effect over the outlet port might be possible. The means defining the outlet port may include inwardly extending flange and the porous body may be inserted to abut the flange. This is convenient for positioning in assembly. In one embodiment, the means defining the outlet port includes one inwardly directed flange at the inner end of the outlet port. This enables the porous body to be inserted from the outer end of the outlet port and also ensures that a gap of at least the thickness of the flange is left between the end of the porous body and the inner end of the outlet port.

Conveniently, a first seal may be provided for the outlet port and a second seal may be provided for a withdrawal member of an ink jet printer when introduced into the port. Preferably, the first and second seals are integral. In this way, manufacture is simplified because both seals can be provided by the insertion of a single integral member. The second seal may conveniently define a resilient opening to receive the withdrawal member and the first seal may comprise a pierceable septum across that opening.

BRIEF DESCRIPTION OF THE DRAWINGS

Four embodiments of the invention will now be described by way of example and with reference to the accompanying drawings, in which.

DETAILED DESCRIPTION

Figure 1:
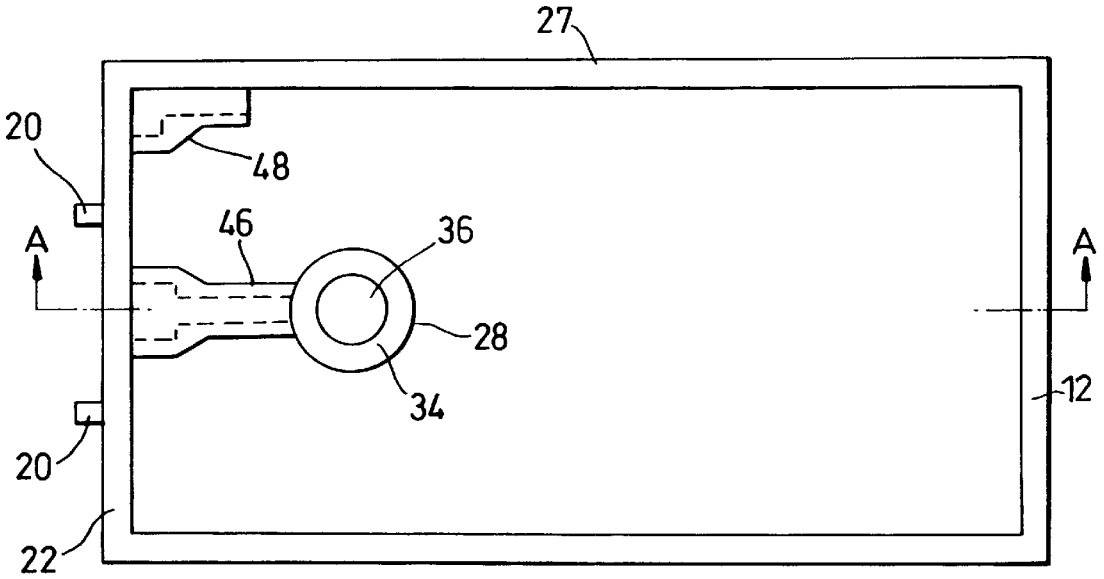
FIG. 1 is a top plan view of a cartridge in a first embodiment of the invention.
Figure 2:
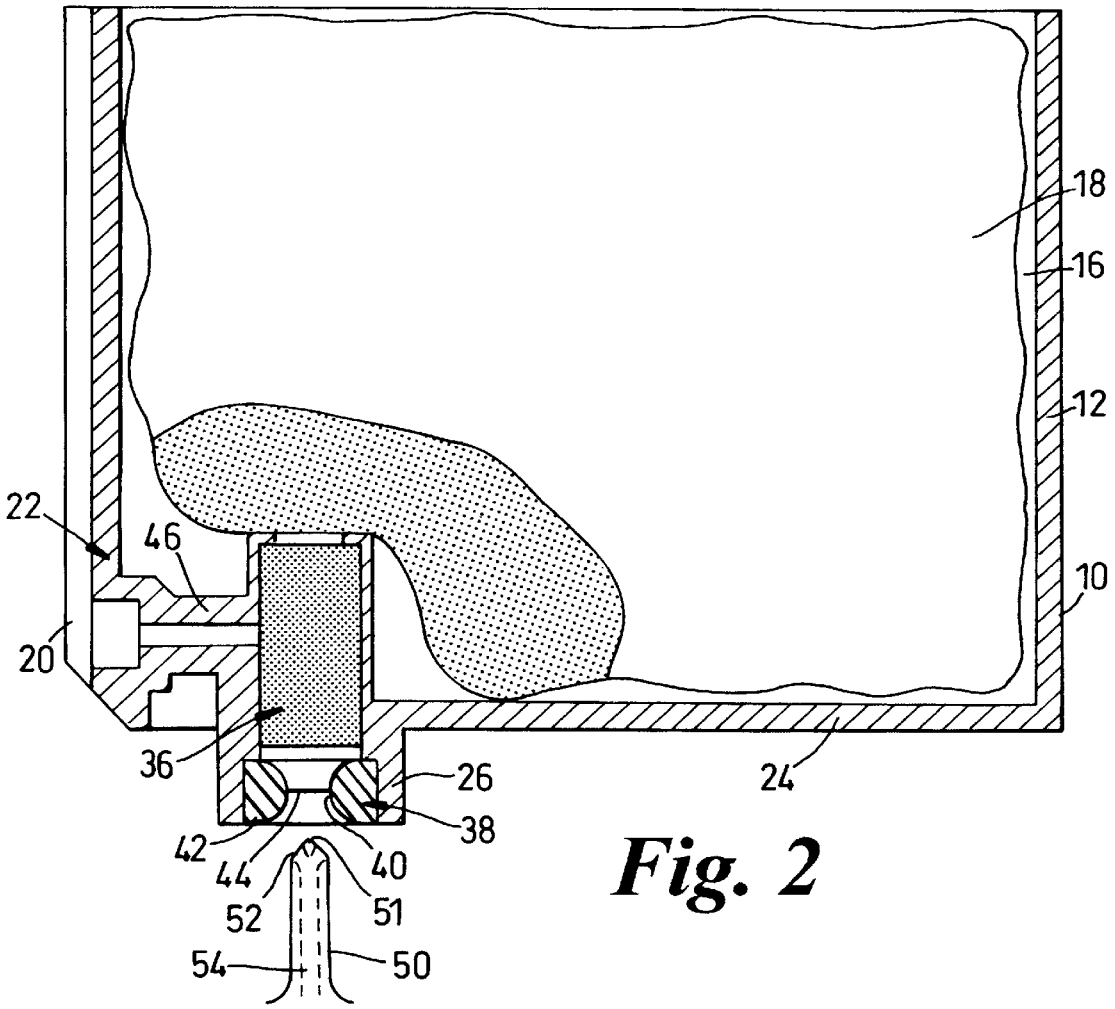
FIG. 2 is a side elevation in cross-section at A'A in FIG. 1, showing an ink withdrawal needle of an ink jet printer adjacent the cartridge.
Figure 3:
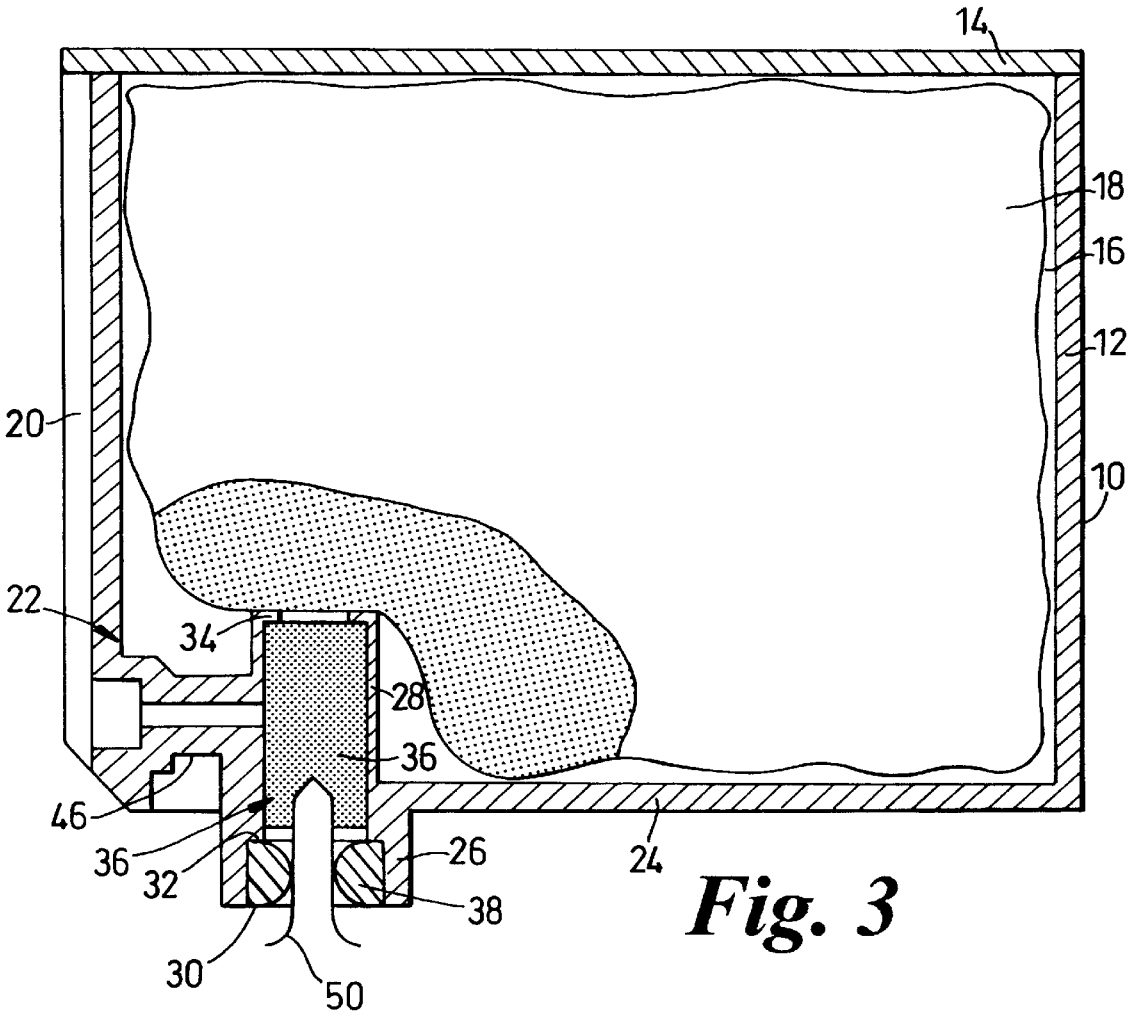
FIG. 3 is the view of FIG. 2 with the cartridge on the needle.

The cartridge 10 of the first embodiment comprises an open topped, generally rectangular tank 12 with a lid 14. The tank 12 with the lid 14 together define an ink reservoir 16 within them. The reservoir 16 is filled with a sponge 18 of polymer material. The tank 12 includes two upright ribs 20 on one end wall 22.

The floor 24 of the tank 12 includes a downwardly extending cylindrical boss 26. The boss 26 is provided centrally between the side walls 27 of the tank 12 and spaced from the end wall 22. A further boss 28 extends upwardly from the floor 24 of the tank 12 into the interior 16 of the tank 12 and is co-axial with the cylindrical boss 26. The bosses 26 and 28 define therein an axial bore 30 which is widest at the outer end of the outer boss 26 and includes an inwards step 32 just before the floor 24. The inner end of the boss 28 includes an inwardly extending flange 34. A fibrous body 36 is provided in the smaller diameter part of the bore 30 and abuts the flange 34. The fibrous body may be made from continuous cellulose acetate fibres bonded with triacetin. An elastomeric seal 38 is provided in the wider diameter part of the bore 30 and abuts the shoulder 32. The seal 38 is generally toroidal, the basic cross-section being D-shaped so that it has a cylindrical outer surface. The opening 40 in the centre of the toroidal part 42 is bridged by a septum 44.

A duct 46 extends from the side 22 of the tank 12 generally horizontally to intersect the bore 30 in the upright boss 28. The duct 46 receives a conductive rod (not shown). A generally parallel duct 48 extends from the same end wall 22 of the tank 12 into the interior of the tank 12 alongside a side wall 50 of the tank 12. The duct 48 also receives a conductive rod (not shown).

The cartridge is intended for use with a printer such as an ink jet printer. That printer includes a withdrawal member in the form of an upright needle 50.

The needle 50 includes a conical tip 51 which is relatively short and therefore relatively blunt. The conical tip 51 includes a plurality of openings 52 which are connected to a central bore 54 leading to a printing head of the ink jet printer (not shown).

In use, the cartridge 10 is placed onto the needle 50. The needle 50 will firstly pierce the septum 44. The toroidal part 42 together with any remainder of the septum 44 will then resiliently grip the parallel sides of the needle 50 as it passes up into the cartridge and the conical end 51 enters the fibrous body 36. Ink may then be withdrawn through the needle 50. The fibrous body 36 acts as a filter for particles of size greater than 10 micrometres and also acts as a wick to ensure continuous ink flow from the reservoir 16 where the ink is held in the porous body 18, into the bore 30 between the flanges 34 and down through the fibrous body 36 to the needle 50.

The conductive rods in the ducts 46,48 are part of a circuit for sensing when the ink level in the cartridge is low. Thus, a potential is applied across the conductive rods. When the ink level is low, the current between the two conductive rods will drop indicating that the cartridge should be replaced. In particular, when the ink volume drops to below a certain level an air gap will form between the sponge 18 and the fibrous body 36 which will break the current path through the ink between the conducting rods.

Figure 4:
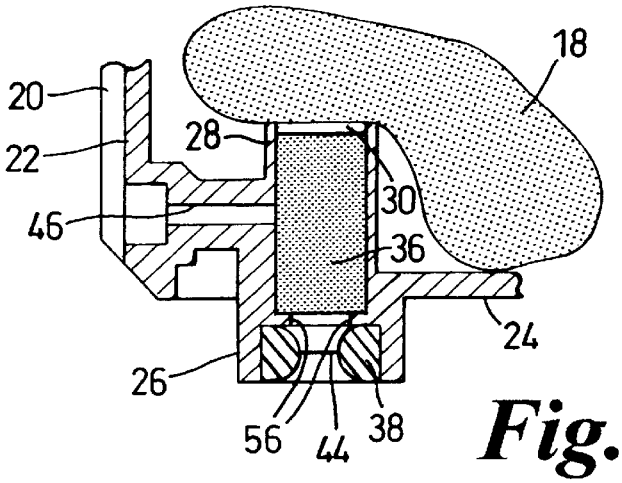
FIG. 4 is a detail side elevation in cross-section of a cartridge in a second embodiment.
Figure 5:
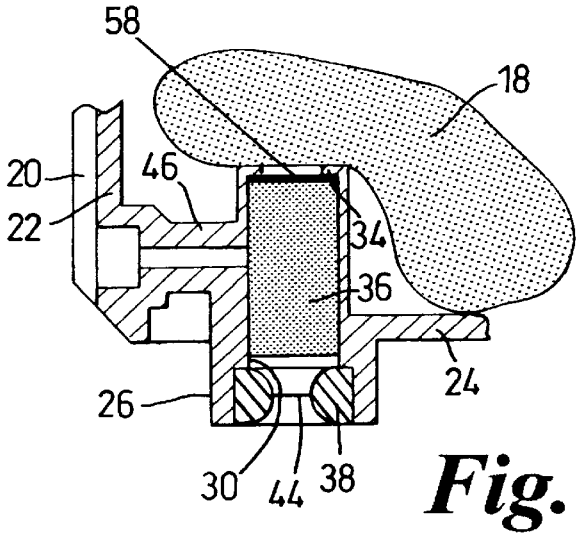
FIG. 5 is a detail side elevation in cross-section of a cartridge in a third embodiment; and, FIG. 6 is a detail side elevation in cross-section of a fourth embodiment.
Figure 6:
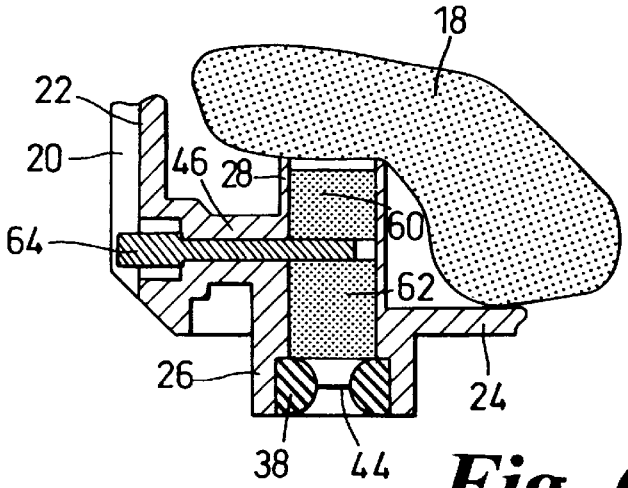

FIGS. 4, 5 and 6 show alternative embodiments which are similar to the first embodiment. The same reference numerals will be used for equivalent features and only the differences from the first embodiment will be described.

In the assembly of the first embodiment, the fibrous body 36 is first inserted into the bore 30 from its lower end and the elastomeric body 38 is then inserted also from the lower end of the bore 30. In the second embodiment, the flanges 34 are omitted, but additional flanges 56 are provided adjacent the shoulders 32 of the bore 30. In this case, the fibrous body 36 is inserted into the bore 30 through the top to abut the flanges 56. The elastomeric seal 38 is then inserted through the bottom of the bore 30 to abut the shoulders 32. Again, the fibrous body 36 is separated from the sponge 18 by a gap as the fibrous body 36 is spaced from the top of the outlet port 30.

The third embodiment is very similar to the first embodiment except that a flat circular stainless steel mesh filter 58 is provided in the bore 30 abutting the flanges 34 and between the flanges 34 and the fibrous body 36. The mesh filter 58 may be of a finer grade than the fibrous body 36 to provide additional filtration.

In the fourth embodiment, the flanges 34 of the first and third embodiments are not provided and the flanges 56 of the second embodiment also are not provided. The fibrous body 36 is provided in two parts, an upper part 60 and a lower part 62. In this case, the conductive rod 64 is first inserted into the duct 46 and in this embodiment extends into the bore 30. The upper part 60 of the fibrous body is inserted through the top of the boss 28 into the bore 30 to abut the upper rod 64, while the lower part 62 of the fibrous body is inserted through the lower end of the bore 30 again to abut the conductive rod 64. The elastomeric seal 38 is then inserted through the lower end of the bore 30. The wicking action of the two parts of the fibrous body is not affected by the gap around the conductive rod 64. The upper end of the upper part 60 of the fibrous body is spaced from the top of the outlet port 30 to leave a gap between the upper part 60 and the sponge 18.

It is thus seen that by means of the invention an effective and efficient cartridge can be produced which comprises fewer components than the prior known cartridge and is assembled in fewer steps.

I claim:

1. An ink cartridge for an ink jet printer comprising:

means defining an ink reservoir;

means defining an ink outlet port from said reservoir, said outlet port being substantially narrower than the reservoir and being arranged to axially receive an axially elongated ink withdrawal member of an ink jet printer;

a filter disposed within said outlet port; and a first seal across said outlet port to be pierced by the withdrawal member of an ink jet printer, wherein the filter comprises a porous body provided in said outlet port, said porous body being arranged to act as a wick for ink flowing through said port in a flow direction from said reservoir, and to act as a filter for particles in the ink of a size greater than 100 micrometers.

2. An ink cartridge as claimed in claim 1, wherein the porous body is arranged to act as a filter for particles of a size greater than 15 micrometers.

3. An ink cartridge as claimed in claim 1, wherein the porous body is arranged to act as a filter for particles of a size greater than 10 micrometers.

4. An ink cartridge as claimed in claim 1, wherein the porous body is fibrous.

5. An ink cartridge as claimed in claim 4, wherein the porous body comprises fibres which are continuous along the body in the flow direction of the port.

6. An ink cartridge as claimed in claim 4, wherein the porous body comprises cellulose acetate fibres.

7. An ink cartridge as claimed in claim 4, wherein the porous body comprises fibres bonded together with a solvent or resin.

8. An ink cartridge as claimed in claim 7, wherein the fibres are bonded together with triacetin.

9. An ink cartridge as claimed in claim 1, wherein the porous body is a solidified foam.

10. An ink cartridge as claimed in claim 1, wherein the porous body is spaced from the inner end of the outlet port.

11. An ink cartridge as claimed in claim 10, wherein a porous element is provided in the reservoir and the porous body and the porous element are arranged such that they do not contact one another.

12. An ink cartridge as claimed in claim 10, wherein the means defining the outlet port includes an inwardly directed flange at the inner end of the outlet port.

13. An ink cartridge as claimed in claim 1, further comprising a second seal provided for the withdrawal member of an ink jet printer when introduced into the port.

14. An ink cartridge as claimed in claim 13, wherein the first seal is integral with the second seal.

15. An ink cartridge as claimed in claim 14, wherein the second seal defines a resilient opening to receive the withdrawal member and the first seal comprises a pierceable septum across the resilient opening.

16. An ink cartridge as claimed in claim 1, wherein said outlet port is axially elongate.

17. An ink cartridge as claimed in claim 16, wherein said porous body also is axially elongated and substantially fully occupies said outlet port.

18. An ink cartridge for an ink jet printer comprising:

means defining an ink reservoir;

means defining an ink outlet port from said reservoir, said outlet port being substantially narrower than the reservoir and being arranged to axially receive an axially elongated ink withdrawal member of an ink jet printer;

a filter disposed within said outlet port; and a first seal across said outlet port to be pierced by the withdrawal member of an ink jet printer, wherein the means defining the outlet port includes an inwardly directed flange and the filter is inserted to abut the flange.

* * * * *